US010704329B2

(12) United States Patent
Campbell et al.

(10) Patent No.: US 10,704,329 B2
(45) Date of Patent: Jul. 7, 2020

(54) CEMENTING WHIPSTOCK ASSEMBLY AND RUNNING TOOL WITH RELEASABLY ENGAGED CEMENT TUBE FOR MINIMIZING DOWNHOLE TRIPS DURING LATERAL DRILL SIDETRACKING OPERATIONS

(71) Applicant: WILDCAT OIL TOOLS, LLC, Midland, TX (US)

(72) Inventors: John E. Campbell, Spring, TX (US); Charles H. Dewey, Tomball, TX (US)

( * ) Notice: Subject to any disclaimer, the term of this patent is extended or adjusted under 35 U.S.C. 154(b) by 0 days.

(21) Appl. No.: 16/689,035

(22) Filed: Nov. 19, 2019

(65) Prior Publication Data

US 2020/0087987 A1 Mar. 19, 2020

Related U.S. Application Data

(63) Continuation-in-part of application No. 16/509,461, filed on Jul. 11, 2019, which is a continuation of application No. 16/503,444, filed on Jul. 3, 2019, and a continuation-in-part of application No. PCT/US2018/025908, filed on Apr. 3, 2018.

(Continued)

(51) Int. Cl.

| | |
|---|---|
| ***E21B 7/06*** | (2006.01) |
| ***E21B 23/01*** | (2006.01) |
| ***E21B 33/134*** | (2006.01) |

(52) U.S. Cl.

CPC ..... *E21B 7/061* (2013.01); *E21B 23/01* (2013.01); *E21B 33/134* (2013.01)

(58) Field of Classification Search

CPC ..... E21B 7/061; E21B 23/01; E21B 23/04; E21B 33/134; E21B 33/13; E21B 33/14; E21B 17/06

See application file for complete search history.

(56) References Cited

U.S. PATENT DOCUMENTS

| | | |
|---|---|---|
| 3,023,810 A | 3/1962 | Anderson |
| 3,136,364 A | 6/1964 | Myers |

(Continued)

OTHER PUBLICATIONS

Wildcat Oil Tools; "HydroVortex Wellbore Debris Removal"; YouTube; Feb. 1, 2017 (retrieved on Jun. 3, 2018); Retrieved from the Internet: URL:https://www.youtube.com/watch?v=9XAb5LjstFo; entire video.

*Primary Examiner* — George S Gray
(74) *Attorney, Agent, or Firm* — Hulsey P.C.

(57) ABSTRACT

A sidetracking assembly employs a running tool for engaging the whipstock. A cement tube flows low-viscosity fluid through the whipstock to set a hydraulically actuable anchor and to transmit fluid cement further downhole in order to set a cement plug. A latch dog releasably associates the running tool with the whipstock. The latch dog disengages the running tool from the whipstock after the anchor is set. The running tool and cement tube can be raised a designed distance using a first pull tension, indicating that the cement tube is not restrained and that therefore an operation to pump cement to form a cement plug below the assembly may be executed. Following the cementing operation, a greater pull tension can be applied to release the cement tube from the whipstock, permitting complete withdrawal of the reusable running tool and cement tube from the wellbore.

20 Claims, 8 Drawing Sheets

Related U.S. Application Data

(60) Provisional application No. 62/696,423, filed on Jul. 11, 2018.

(56) References Cited

U.S. PATENT DOCUMENTS

| | | | | |
|---|---|---|---|---|
| 4,296,822 | A | 11/1981 | Ormsby | |
| 5,035,292 | A | 7/1991 | Bailey | |
| 5,402,850 | A | 4/1995 | Lalande et al. | |
| 5,443,129 | A | 8/1995 | Bailey | |
| 5,771,972 | A | 6/1998 | Dewey | |
| 5,829,531 | A | 11/1998 | Hebert | |
| 6,102,123 | A | 8/2000 | Bailey | |
| 6,648,068 | B2 | 11/2003 | Dewey | |
| 2008/0093076 | A1 | 4/2008 | Patil et al. | |
| 2009/0101362 | A1 | 4/2009 | Loughlin | |
| 2010/0276145 | A1 | 11/2010 | Dewey et al. | |
| 2010/0288492 | A1 | 11/2010 | Blackman et al. | |
| 2012/0222902 | A1 | 9/2012 | Alsup | |
| 2012/0298369 | A1 | 11/2012 | Knobloch, Jr. et al. | |
| 2013/0213654 | A1* | 8/2013 | Dewey | E21B 7/061 166/285 |
| 2013/0299160 | A1 | 11/2013 | Lott | |
| 2015/0226010 | A1 | 8/2015 | Drews | |
| 2016/0053559 | A1 | 2/2016 | Alley | |

* cited by examiner

CEMENTING WHIPSTOCK ASSEMBLY AND RUNNING TOOL WITH RELEASABLY ENGAGED CEMENT TUBE FOR MINIMIZING DOWNHOLE TRIPS DURING LATERAL DRILL SIDETRACKING OPERATIONS

FIELD OF THE INVENTION

The present disclosure relates to field production equipment for extracting hydrocarbon energy resources from an oilfield and, more particularly, to a cementing whipstock assembly and running tool for minimizing downhole trips during lateral drill sidetracking operations. Yet more particularly, the present disclosure relates to a running tool for use with a cementing whipstock, where the running tool partially releases from the whipstock before pumping cement so as to give an indication that it is unrestrained and may be fully withdrawn from the wellbore after pumping cement. The embodiments described further relate to an assembly and operating methods for cementing a portion of a wellbore through an assembly to enable a sidetrack tracking operation with a single trip down the wellbore. Embodiments disclosed herein relate more specifically to a running tool that releasably releases from the whipstock in response to a pressure-pumping event such that a slidably sealed cement conductor tube remains engaged within the whipstock, permitting a short-distance pull test indicating that the running tool is unrestrained for post-cementing cement tube withdrawal.

BACKGROUND OF THE INVENTION

Whipstocks, in essence, are long ramps that direct a milling or drilling assembly laterally into a tubular wall to form an opening referred to as a window for a lateral exit from a main bore. These whipstocks have to be properly oriented so that the mill will exit in a desired orientation into the oilfield's producing or injection zone, depending on the application. Measurement while drilling (MWD) or wireline gyro tools assist in the orientation of the whipstock ramp before an underlying anchor is set for fixation of the whipstock.

Traditionally, prior art whipstocks have been used to drill deviated boreholes from an existing wellbore. A whipstock has a ramped surface that is set in a predetermined position to guide a drill bit or drill string in a deviated manner to drill into the side of the wellbore, which may also be called a sidetrack window or window. In operation, the whipstock is positioned, or set, on the bottom of the existing wellbore. The set position of the whipstock is then surveyed and the whipstock is properly oriented for directing a drill string in the proper direction. The direction of the drill string determines the production effort's ability to achieve the desired hydrocarbon resources extraction. After the whipstock is set, a drill string is lowered into the well to engage with the whipstock, thus causing the drill string to drill a deviated borehole through a wall of the existing wellbore.

Other uses for prior art whipstocks include sidetracking from previously drilled and cased/uncased wellbores that have become unproductive. For example, when a wellbore becomes unusable, a new borehole may be drilled in the vicinity of the existing cased or uncased wellbore. Alternatively, a new borehole may be sidetracked from the serviceable portion of the existing, cased or uncased wellbore. Sidetracking from a cased or uncased wellbore also may be useful for developing multiple production zones. This procedure can be accomplished by milling through the side of the casing and/or into the wellbore wall with a mill that is guided by a wedge or whipstock component. After a milling or drilling procedure is completed, the whipstock may be removed from the wellbore.

A currently available design for a known mechanically supported whipstock and anchor enables the running tool to engage a whipstock opening. Typically, the running tool has a hook that engages an opening in the whipstock ramp. A shear pin or bolt initially secures the running tool to the top of the ramp when running in. The running tool has an extension tube that runs through the whipstock body under the ramp and into a seal bore of a bottom sub connected below the ramp. An anchor may be located below bottom sub. The procedure with this design traditionally includes cementing through the anchor onto a support that exists in the borehole and that is not shown to create a barrier that may be requested by some operators. When cementing to create a barrier is concluded, a ball is dropped on a seat near the anchor to set the anchor. The prior art running tool may be then released by shearing a pin or bolt by setting down weight against the set anchor to get the hook out of an opening in the ramp, followed by rotating before pulling out of the hole with the running tool, so as to avoid re-engaging the hook in the opening on the way out of the hole.

First, the uncased portion of the wellbore needs to be cemented. In this known or prior art configuration, a cementing assembly may be connected to a drill string and run down the wellbore until it is positioned into an uncased portion of the wellbore. The entire wellbore may be uncased or the lower portion below the casing may be uncased. Cement is pumped down the drill string and out the assembly to cement the uncased portion of the wellbore. After cementing the uncased bore of a wellbore, the drill string may be removed from the wellbore and a mill may be run down the wellbore. When the mill is positioned adjacent to the newly cemented portion of the wellbore, the mill will be actuated and moved downward. The mill will continue to travel down the wellbore until it engages a whipstock, which changes the direction of the mill causing it to produce a sidetrack of the wellbore.

The repeated trips down the wellbore of the prior art devices in order to position the cementing assembly, remove the drill string, insert, orient and position the whipstock are time consuming and costly. It would be beneficial to reduce the amount of time required to perform the operation of cementing and subsequently sidetracking in the wellbore.

There are, thus, several limitations in this prior art process. One is that the known running tool may be positioned in a highly deviated portion of a borehole making rotation difficult and further reducing surface feedback as to how much rotation has actually taken place at the hook with a given amount of rotation at the surface. In a deviated borehole, rubbing on the wall can result in far less rotation at a downhole end of a string than the rotation applied at the surface.

The presently described running tool for use within a cementing whipstock assembly addresses the above known limitations of existing technologies. The benefits of this new running tool with a releasably-engaged cement tube for minimizing downhole trips during a cementing operation is here describe and claimed.

BRIEF SUMMARY OF THE DISCLOSURE

The present disclosure provides for a cementing whipstock assembly and running tool for minimizing downhole trips during lateral drill sidetracking operations and more particularly where the running tool releases from the whipstock before pumping cement through the anchor and, further, that remains releasably attached until completing the cementing operation to provide a clear indication of the cement tube position.

According to one aspect of the presently disclosed subject matter, here is provided an assembly for subterranean use and employing a reusable running tool in association with a whipstock and anchor combination. The assembly includes a running tool connected to a whipstock with a hydraulically actuated anchor and anchor setting sub located proximally downhole from the whipstock. U.S. patent application Ser. No. 16/509,461, entitled "DUAL-ACTION HYDRAULICALLY OPERABLE ANCHOR AND METHODS OF OPERATION AND MANUFACTURE FOR WELLBORE EXIT MILLING,", and filed on Jul. 11, 2019 provides a description of the anchor for use with the running tool of the present disclosure and is hereby expressly incorporated by reference in its entirety. This anchor system provides a cooperative anchor for use with the running tool of the present disclosure.

The assembly is oriented in a desired direction, and then the hydraulically actuated anchor is set with a low viscosity fluid, such as water or a lightweight drilling mud. A reusable running tool is connected to the whipstock and is located uphole adjacent to the whipstock. The running tool includes a running tool body for engaging the whipstock and providing structural support and fluid communication through the running tool while the running tool is engaged to the whipstock. A cement tube operates in selective fluid communication with the running tool body for receiving fluid such as water, mud, or fluid cement from the running tool body and flowing the fluid through the whipstock through the anchor and downhole-adjacent anchor setting sub. A latch dog controllably and releasably associates the running tool with the whipstock.

The hydraulically actuated anchor is set in place by flowing a ball in a low viscosity fluid to a ball seat in a ball seat carrier located in the anchor setting sub, with this sub located downhole-adjacent from the anchor. The seated ball blocks flow, allowing pressure to build in the anchor. Pressure pumped from the surface is increased until pistons inside the anchor actuate, driving slips radially outward to engage the wellbore wall and to hold the assembly in position.

A pressure-activated withdrawal mechanism partially releases the whipstock after the anchor is set and indicates thereby the position of the cement tube within the whipstock. A latch dog located in two 45-degree symmetrically angled cavities or "pockets," the whipstock pocket and running tool pocket, cause a portion of the latch dog to retain the whipstock and running tool body and locking sleeve catcher together, preventing any sliding motion. The radially inward movement of the latch dog is enabled by the locking sleeve shifting downward after a second ball drop that follows the ball drop that set the anchor, and the force applied by the angled whipstock pocket and running tool pocket forcing the latch dog out of the whipstock pocket and inward until it is situated in only the running tool pocket and latch dog pocket. At this point, with the latch dog only retained in the running tool pocket and latch dog pocket, the running tool body and locking sleeve catcher are enabled to slidably travel vertically independently of the whipstock. Flat faces of the running tool body abut the face of the whipstock serve as a torsional restraint, preventing the running tool from rotating prior to release of the running tool. After the latch dog has been actuated to its radially inward position, a pull test is performed. Pulling force is applied from a rig at the surface, with the workstring, along with the running tool body, locking sleeve catcher and cement tube being pulled in an uphole, upward direction. The vertical travel in the pull test traverses only a short distance, such as two or three feet, so that the cement tube remains slidably and sealably engaged inside the whipstock, but a visual indication is provided showing the cement tube to be unrestrained. Upward vertical travel at this stage is limited, by shear screws, to a maximum of four feet (in some embodiments) from the point at which the latch dog has moved to its radially inward position.

A pull test is performed in order to provide an indication that the cement tube and the running tool are vertically movable and may be extracted from the wellbore following the cement pumping operation. With this indication received at the surface, the cement pumping operation commences.

After fluid cement is pumped downhole to set the cement plug, the running tool, known to be movable from the first pull test, can be pulled with force sufficient to shear the shear screws retaining the cement tube in the whipstock and released from the whipstock in its entirety and brought to the surface. The running tool is fully withdrawn from the wellbore, and with this full withdrawal of the reusable running tool it may be redressed and used in subsequent cement setting operations.

Considering another aspect of the present disclosure, here is provided a method of drilling a deviated wellbore (e.g., sidetracking). An assembly includes a running tool connected to a whipstock with a hydraulically actuated anchor and anchor setting sub located proximally downhole from the whipstock. The assembly is oriented in a desired direction, and then the hydraulically actuated anchor is set with a low viscosity fluid, such as water or a lightweight mud. This reusable running tool is connected to the whipstock and is located uphole adjacent to the whipstock. A cement tube operates in selective fluid communication with the running tool body for receiving fluid such as water, mud, or fluid cement from the running tool body and flowing the fluid through the whipstock through the anchor and downhole-adjacent anchor setting sub. By setting the hydraulic anchor that supports the whipstock, releasing a releasable latch in the running tool to free it for a pull test while sealably retaining a sliding cement tube, performing a cementing operation and subsequently withdrawing the running tool and cement tube from the wellbore, a method is provided through which a single-trip whipstock-setting and cement-pumping operation may be reliably executed.

A technical advantage of the running tool is to provide an indication, prior to cementing, that the running tool and cement tube is movable and not restrained from vertical travel. This is of practical importance to operators, as they prefer not to proceed with a cementing operation if there is a possibility that the running tool, cement tube and entire assembly could become stuck, i.e. immobilized in set cement, and impossible to withdraw from the wellbore. Such a situation could necessitate, in the worst case, the drilling of a new vertical wellbore.

An additional key technical advantage is that overtravel of the cement tube is limited, preventing its accidental removal from its sealable engagement in the whipstock. Overtravel is prevented by a larger diameter portion of the cement tube that stops when it encounters a plurality of shear screws inserted through the whipstock at the point at which vertical travel would reach its maximum of four feet, in some embodiments. However, depending on the use, travel limits may vary according to the particular environment, wellbore, and other physical characteristics.

Another technical advantage of this disclosure is that no shearable mechanism is at risk of shearing while the assembly is being tripped into the wellbore. If any wellbore difficulties are encountered and the assembly experiences extreme shocks or forces of compression, tension or torsion, the latch dog will remain immovably engaged, retaining the running tool and whipstock together.

Yet another technical advantage of this disclosure is that a pull test, i.e. the test ensuring that the running tool and cement tube are unrestrained and slidably movable, may be performed at any time before or during the cementing operation.

The above advantageous features and technical advantages are described below in the technical description of the disclosed subject matters and claimed in the claims asserted thereafter.

BRIEF DESCRIPTION OF THE DRAWINGS

The present subject matter will now be described in detail with reference to the drawings, which are provided as illustrative examples of the subject matter so as to enable those skilled in the art to practice the subject matter. Notably, the figures and examples are not meant to limit the scope of the present subject matter to a single embodiment, but other embodiments are possible by way of interchange of some or all of the described or illustrated elements and, further, wherein.

DETAILED DESCRIPTION OF ILLUSTRATIVE EMBODIMENTS

Figure 1:
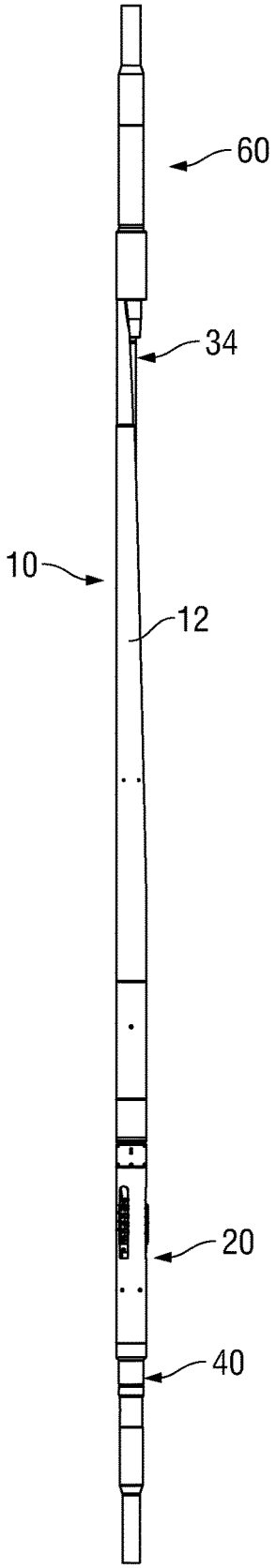
FIG. 1 illustrates an isometric view of a wellbore sidetracking assembly using a whipstock assembly and running tool for single-trip cementing operations according to the teachings of the present disclosure.

The detailed description set forth below in connection with the appended drawings is intended as a description of exemplary embodiments in which the presently disclosed process can be practiced. The term "exemplary" used throughout this description means "serving as an example, instance, or illustration," and should not necessarily be construed as preferred or advantageous over other embodiments. The detailed description includes specific details for providing a thorough understanding of the presently disclosed method and system. However, it will be apparent to those skilled in the art that the presently disclosed process may be practiced without these specific details. In some instances, well-known structures and devices are shown in block diagram form in order to avoid obscuring the concepts of the presently disclosed method and system.

In the following description, numerous details are set forth to provide an understanding of the disclosed embodiments. However, it will be understood by those of ordinary skill in the art that the disclosed embodiments may be practiced without these details and that numerous variations or modifications may be possible without departing from the scope of the disclosure.

The disclosed embodiments generally relate to a system and method designed to facilitate sidetracking operations in which at least one lateral/deviated wellbore (i.e., borehole) is formed with respect to another wellbore, e.g., with respect to a vertical wellbore. Certain embodiments disclosed herein relate to a sidetracking system including a whipstock assembly combined with a running tool having a cement tube coupled to a sub of the sidetracking system by a releasable latch mechanism. In some embodiments, the whipstock assembly has a central bore therethrough, and the sidetracking system also comprises an expandable anchor assembly configured to be hydraulically actuated and set at a specific depth in a wellbore. In some embodiments, the sidetracking system may further comprise a removable flow blocking member to restrict a fluid flow and to increase a pressure in the central bore to actuate the expandable anchor. The sidetracking system enables setting of the whipstock and creation of a cement plug in a single trip downhole into the wellbore.

The hydraulically actuated anchor is set in place by "dropping a ball," i.e. flowing a ball in a low viscosity fluid to a ball seat in a ball seat carrier located in the anchor setting sub, with this sub located downhole-adjacent from the anchor. This anchor setting ball is dropped and lands in the seat of the ball seat carrier inside the anchor setting sub, stopping flow from proceeding downhole from the anchor setting sub. Pressure pumped from the surface is increased until pistons inside the anchor actuate, driving slips radially outward to engage the wellbore wall and to hold the assembly in position. Following anchor actuation, additional pressure pumped from the surface is applied to release the ball seat carrier in the anchor setting sub. Upon release, fluid flow may again proceed downhole through the anchor setting sub, allowing a cementing operation to take place.

A pressure-activated withdrawal mechanism partially releases the whipstock after the anchor is set and indicates thereby the position of the cement tube within the whipstock. A second ball, of larger diameter than the anchor setting ball, is configured to land in a seat inside a locking sleeve in the center of the running tool. Upon the ball's landing in the seat inside the locking sleeve at the sleeve's distal, downhole end, the ball seals a central, axial bore in this locking sleeve, causing the locking sleeve to now function as a sliding hydraulic piston. After the ball seats, flow through the central bore of the locking sleeve stops, which also stops fluid flow from proceeding further downhole through the cement tube, anchor and anchor setting sub. With the addition of sufficient pressure pumped from the surface, the locking sleeve shears a plurality of shear screws that hold it in place. The locking sleeve slides downward, downhole, until it passes into a locking sleeve catcher that contains a locking sleeve cavity, with the cavity being of larger inside diameter than the outside diameter of the locking sleeve, and the locking sleeve ends its travel on a flat face at the bottom of the cavity. At this point, fluid ports formed radially in the lower portion of the locking sleeve enter into fluid communication with a flow passageway in the locking sleeve catcher. This flow passageway leads to another cavity, the lower locking sleeve cavity, that is located proximal to and downhole from the locking sleeve cavity. The locking sleeve abuts the upper end of the cement tube, with the locking sleeve cavity's inside diameter fitting threadably and sealably over the outside diameter of the upper end of the cement tube. In sum, following actuation of the locking sleeve via ball drop, fluid pumped from the surface regains fluid communication with the cement tube and the flowpath is reestablished to the downhole portion of the wellbore beyond the anchor setting sub.

Additionally, following actuation of the locking sleeve, a latch dog located in two cavities or "pockets," the whipstock pocket and running tool pocket, actuates in a radially inward direction. The radially inward actuation is facilitated by the 45-degree symmetrically angled whipstock pocket faces matching the congruent angles of the faces of the radially distal (from axial center of the assembly) portion of latch dog. The inward actuation causes a portion of the latch dog to move into a third, innermost pocket, the latch dog pocket located in the locking sleeve, while a portion remains in the running tool pocket. Initially, before actuation, the latch dog retains the whipstock and running tool body and locking sleeve catcher together, preventing any sliding motion. The radially inward movement of the latch dog is enabled by the locking sleeve shifting downward after ball drop, and the force applied by the angled whipstock pocket and running tool pocket forcing the latch dog out of the whipstock pocket and inward until it is situated in only the running tool pocket and latch dog pocket. At this point, with the latch dog only retaining the running tool pocket and latch dog pocket, the running tool body and locking sleeve catcher are enabled to slidably travel vertically, independently of the whipstock. The running tool body is not permitted to rotate, however. The running tool body has flat faces milled along its exterior. These flat faces of the exterior of the running tool body abut the face of the whipstock and serve as a torsional restraint, preventing the running tool from rotating prior to release of the running tool. At the lower, downhole end of the running tool body, it threadably connects to the locking sleeve catcher, with the locking sleeve catcher being threadably connected to the upper end of the cement tube.

After the latch dog has been actuated to its radially inward position, a pull test is performed. Pulling force is applied from a rig at the surface, with the workstring, along with the running tool body, locking sleeve catcher and cement tube being pulled in an uphole, upward direction. The vertical travel in the pull test traverses only a short distance, such as one or two feet, so that the cement tube remains slidably and sealably engaged inside the whipstock, but a visual indication is provided showing the cement tube to be unrestrained. Upward vertical travel at this stage is limited to a maximum of four feet, for example, from the point at which the latch dog has moved to its radially inward position. The vertical travel is limited by a larger diameter portion of the cement tube contacting, at this portion's circumferentially-protruding flat upper face, a plurality of shear screws inserted through the whipstock and extending radially inward into its central bore to block travel of the larger diameter portion of the cement tube. These shear screws may be calibrated to shear at a significantly higher value than the pulling force required for upward vertical travel, providing a stop that eliminates accidental overtravel. Overtravel could result in the cement tube pulling out of the whipstock and losing its sealable engagement in the central bore of the whipstock. In sum, the pull test is performed in order to provide an indication of the cement tube's position and that the cement tube and the running tool are vertically movable and may be extracted from the wellbore following the cement pumping operation. With this indication received at the surface, the cement pumping operation commences.

The running tool is fully withdrawn from the wellbore following cementing, with this full withdrawal of the reusable running tool permitting its redress and use in subsequent cement setting operations. After fluid cement is pumped downhole to set the cement plug, the running tool, known to be movable from the first pull test, can be pulled with force sufficient to shear the shear screws retaining the cement tube in the whipstock and released from the whipstock in its entirety and brought to the surface.

Considering another aspect of the present disclosure, here is provided a method of drilling a deviated wellbore (e.g., sidetracking). An assembly includes a running tool connected to a whipstock with a hydraulically actuated anchor and anchor setting sub located proximally downhole from the whipstock. The assembly is oriented in a desired direction, and then the hydraulically actuated anchor is set with a low viscosity fluid, such as water or a lightweight mud. A reusable running tool is connected to the whipstock and is located uphole adjacent to the whipstock. The running tool includes a running tool body for engaging the whipstock and providing structural support and fluid communication through the running tool while the running tool is engaged to the whipstock. A cement tube operates in selective fluid communication with the running tool body for receiving fluid such as water, mud, or fluid cement from the running tool body and flowing the fluid through the whipstock through the anchor and downhole-adjacent anchor setting sub. By setting the hydraulic anchor that supports the whipstock, releasing a releasable latch in the running tool to free it for a pull test while sealably retaining a sliding cement tube, performing a cementing operation and subsequently withdrawing the running tool and cement tube from the wellbore, a method is provided through which a single-trip whipstock-setting and cement-pumping operation may be reliably executed.

A technical advantage of the running tool is to provide an indication, prior to cementing, that the running tool and cement tube is movable and not restrained from vertical travel. This is of practical importance to operators, as they prefer not to proceed with a cementing operation if there is a possibility that the running tool, cement tube and entire assembly could become stuck, i.e. immobilized in set cement, and impossible to withdraw from the wellbore. Such a situation could necessitate, in the worst case, the drilling of a new vertical wellbore. A positive indication that the cement tube is free occurs when the surface rig pulls upward, after the latch dog has actuated radially inward, and raises the workstring upward, uphole, approximately two feet, in some embodiments. With a maximum of four feet of travel possible, in some embodiments, before the cement tube pulls out from the whipstock, approximately half of that travel has occurred, and the indication to the operator is that a short distance of two feet, in some embodiments, remains to pull the cement tube completely free of the whipstock following the cementing operation. An additional key technical advantage is that overtravel of the cement tube is limited, preventing its accidental removal from its sealable engagement in the whipstock. Overtravel is prevented by a larger diameter portion of the cement tube that stops when it encounters a plurality of shear screws inserted through the whipstock at the point at which vertical travel would reach its maximum of four feet, for example. These shear screws may be calibrated to shear at a significantly higher value than the pulling force required for the pull test's upward vertical travel, hence providing the stop against overtravel. This is critical as any situation in which the cement tube would be accidentally withdrawn from the whipstock before cementing would jeopardize the entire cementing and sidetracking operation. Thus, the running tool of the present disclosure provides the technical advantage of allowing the operator to pull the running tool out from the whipstock up to a point of indicating its location, sliding the cement tube uphole but retaining its seal in the central bore of the whipstock without fully disengaging the cement tube from the whipstock. This provides a meaningful indication, visible at the surface, of the cement tube location and the status of the cementing operation, without risk of disturbing other downhole components. As a practical example, if the shear value for the shear screws retaining the cement tube as a stop against overtravel equals approximately 10,000 pounds, the cement tube would be retained in a pull test without an adverse event happening, such as accidental release of the hydraulic anchor, whose shear screw values would be set considerably higher. The releasably engaged cement tube thus provides meaningful information relating to the status of readiness for the cementing operation and readiness for withdrawal from the wellbore.

Another technical advantage of this disclosure is that no shearable mechanism is at risk of shearing while the assembly is being tripped into the wellbore. If any wellbore difficulties are encountered and the assembly experiences extreme shocks or forces of compression, tension or torsion, the latch dog will remain immovably engaged, retaining the running tool and whipstock together. Thus the disclosed invention effectively prevents accidental separation of the running tool from the whipstock.

Yet another technical advantage of this disclosure is that a pull test, i.e. the test ensuring the the running tool and cement tube are unrestrained and slidably movable, may be performed at any time before or during the cementing operation.

Now turning to the FIGUREs of this disclosure, FIG. 1 illustrates an isometric view of a wellbore sidetracking assembly using a whipstock assembly utilized for single-trip cementing operations in open hole wellbores, including a latch-release running tool according to the teachings of the present disclosure. FIG. 1 illustrates sidetracking assembly 10 which includes whipstock 12 attached to with running tool 60 with hydraulically actuated anchor 20 and anchor setting sub 40 attached below whipstock 12. The upper portion of cement tube 34 visibly protrudes from the upper, uphole end of whipstock 12.

Figure 2A:
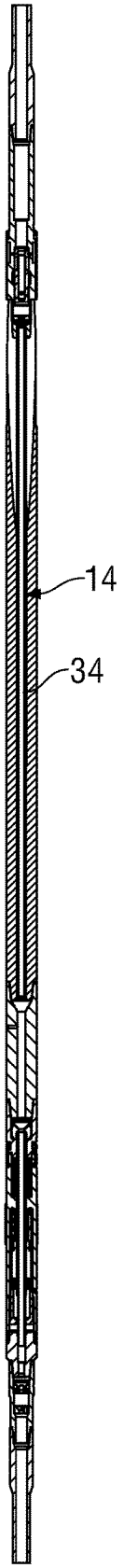
FIG. 2A illustrates a side section view, rotated 90 degrees from the view in FIG. 1, of the sidetracking assembly in association with the running tool formed according to the teachings of the present disclosure.

FIG. 2A illustrates a side section view of sidetracking assembly 10, rotated ninety degrees from FIG. 1, with cement tube 34 inserted into central bore 14, said central bore 14 runs longitudinally through the central axis of the whipstock 12.

Figure 2B:
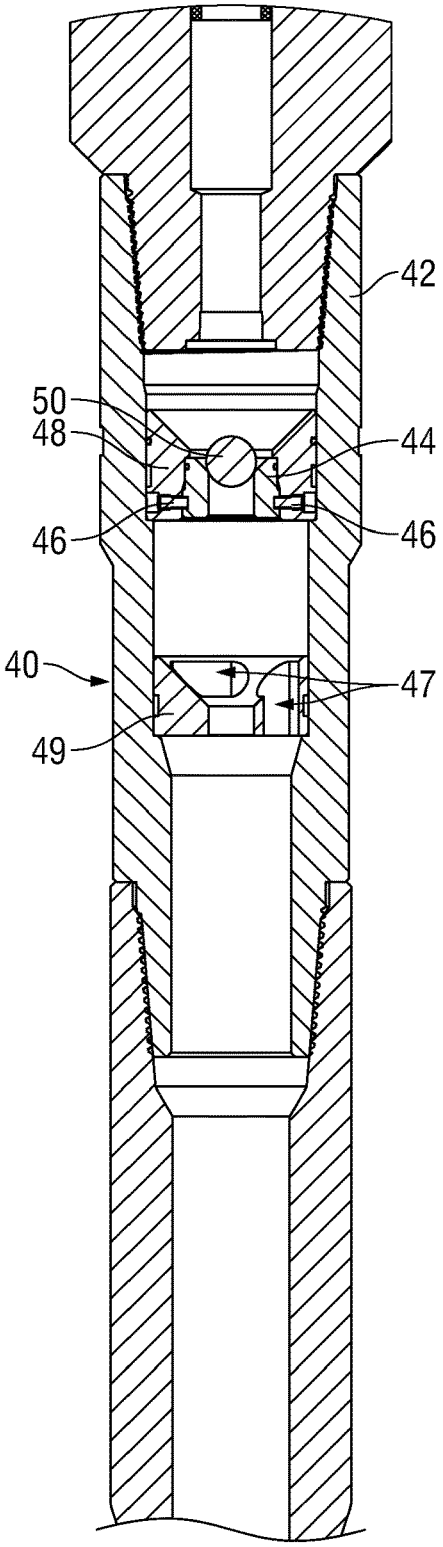
FIG. 2B illustrates an enlarged section view of the anchor setting sub assembly of the present disclosure.

FIG. 2B illustrates an enlarged section view of the anchor setting sub 40, which threadably connects to anchor 20 at lower, downhole end of anchor 20. The anchor setting sub 40 is in fluid communication with the surface rig and is used to set anchor 20 of FIGS. 3A and 3B below such that anchor 20 engages the wellbore wall. The term "dropping a ball" here describes the action of flowing a ball 50 from the surface in a low viscosity fluid so that it lands on a seat of ball seat carrier 44 located inside anchor setting sub 40. Sub 40 is positioned concentric to the central axis of anchor setting sub body 42. Ball seat carrier 44 is positioned flush with the inside diameter of ball seat housing 48, and held in position by a plurality of shear screws 46 threadably inserted into both ball seat carrier 44 and ball seat housing 48. When ball 50 seats in ball seat carrier 44 and throughflow is stopped and pumped pressure builds, shear screws 46 shear and release the ball seat carrier 44 from ball seat housing 48, with ball seat carrier 44 landing against ball catch housing 49. Ball catch housing 49 is manufactured with irregular, asymmetrical grooves and passageways 47 to allow throughflow regardless of the angle and position in which ball seat carrier 44 lands. Ensuring downhole throughflow through anchor setting sub 40 after the release of ball seat carrier 44 is critical for a successful cementing operation.

Figure 3A:
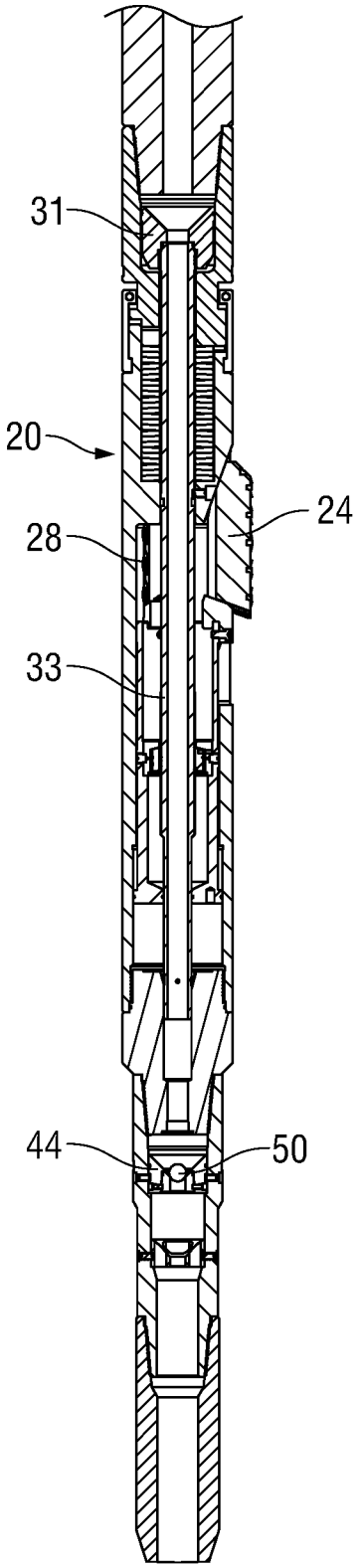
FIGS. 3A and 3B depict the hydraulically actuable anchor that engages the wellbore wall and holds the sidetracking assembly in place.
Figure 3B:
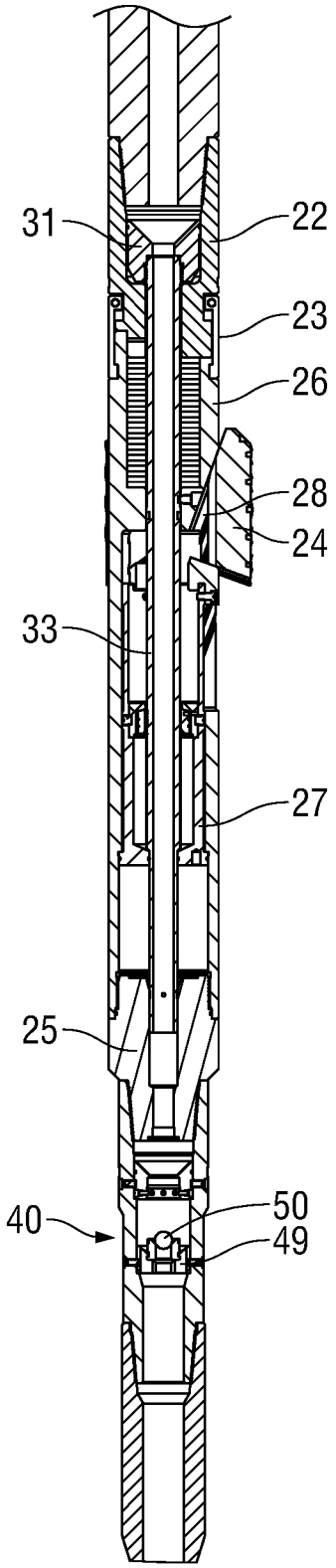

FIGS. 3A and 3B depict hydraulically actuable anchor 20 that engages the wellbore wall and holds sidetracking assembly 10 in place. Hydraulically actuable anchor 20 is shown in half section view, with progressive stages of actuation, from ball 50 seating in FIG. 3A and stopping throughflow in order to extend slips 24, to ball seat carrier 44 having sheared free and traveled downhole to land on ball catch housing 49, reestablishing throughflow. While not the focus of this disclosure, FIGS. 3A and 3B depict anchor 20 in some detail. Upper sub 22 is retained slidably with anchor body 26 by split clamps 23. Two split clamps 23 are held in place by screws (not shown) joining the two pieces together and by screws that externally pass through the lower circumference of the split clamps and thread into anchor body 26. The slips 24 are slidably engaged in grooved pockets 28 in anchor body 26 serving as guides along which slips 24 can slide outward from anchor body 26 to engage the wellbore wall. Slips 24 have holes that contain cylindrical inserts (not shown) of a hard material that gain purchase on the wellbore wall, frictionally binding to it and slightly deforming it under extreme compressive force. Shear screw holes (not shown) receive shear screws (not shown) that hold anchor body 26 and lower piston 27 in a fixed position until hydraulic force is applied, severing the screws connecting anchor body 26 and lower piston 27 and enabling lower piston 27 to travel in an upward, uphole direction. At the lower end of hydraulic anchor 20, a threadably attached end cap 25 with central throughbore threadably attaches to anchor setting sub 40.

With ball 50 seated and increasing pressure pumped, upper piston 31 actuates to force mandrel 33 downward as lower piston 27 actuates to advance slidably upward along the outside diameter of mandrel 33, causing slips 24 to move radially outward from anchor 20 until the wellbore wall is engaged. Following anchor actuation and prior to a cement pumping operation, additional pressure is added to release ball seat carrier 44 in order to reestablish throughflow.

Figure 4A:
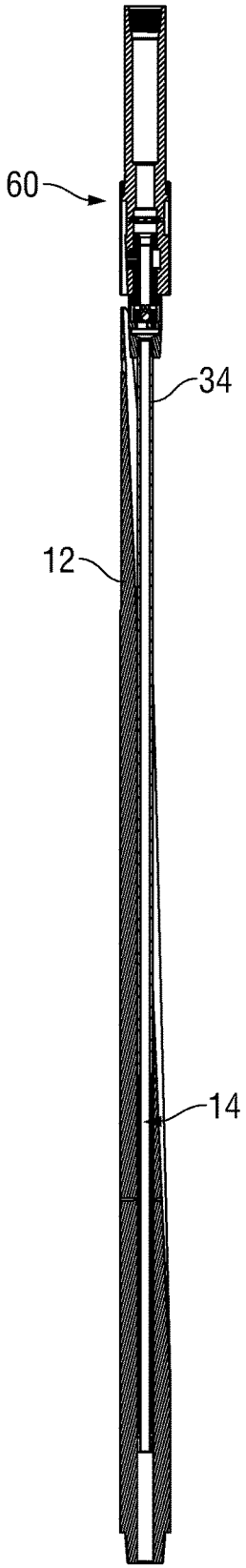
FIG. 4A illustrates in side section view a whipstock, whipstock's central bore, cement tube, and running tool according to the teachings of this disclosure.

FIG. 4A illustrates in side section view a whipstock 12, central bore 14, cement tube 34, and running tool 60. The upper portion of FIG. 4A is marked for enlargement, with enlarged section views appearing in FIGS. 4B and 4C.

Figure 4B:
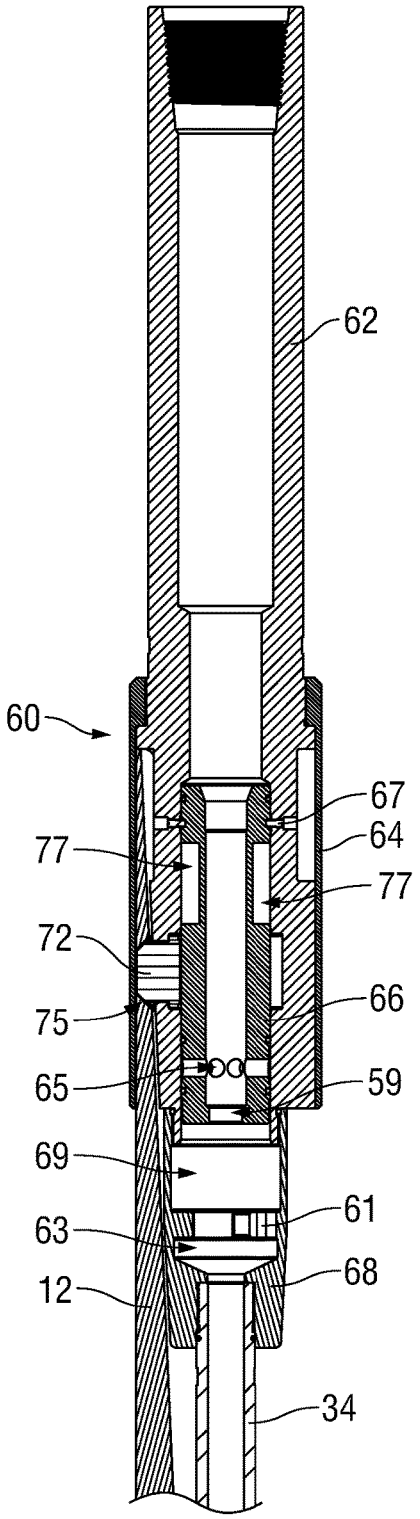
FIG. 4B and FIG. 4C depict enlarged section views of the running tool in different states of latch dog engagement in relation to the whipstock.

Referring to FIG. 4B, running tool 60 connects to whipstock 12. While not shown in FIGS. 4A through 4C, hydraulically actuable anchor 20 and anchor setting sub 40 are located proximally downhole from whipstock 12 as in FIG. 1. The running tool 60 includes a running tool body 62 for engaging whipstock 12 and providing structural support and fluid communication through running tool 60 while running tool 60 is engaged to whipstock 12. A cement tube 34 operates in selective fluid communication with running tool body 62 for receiving fluid such as water, mud, or fluid cement from running tool body 62 and flowing the fluid through whipstock 12 and through anchor 20 and downhole-adjacent anchor setting sub 40. A body sleeve 64 fits over running tool body 62 and whipstock 12, serving to retain and protect internal components of running tool 60 during operation.

Figure 4C:
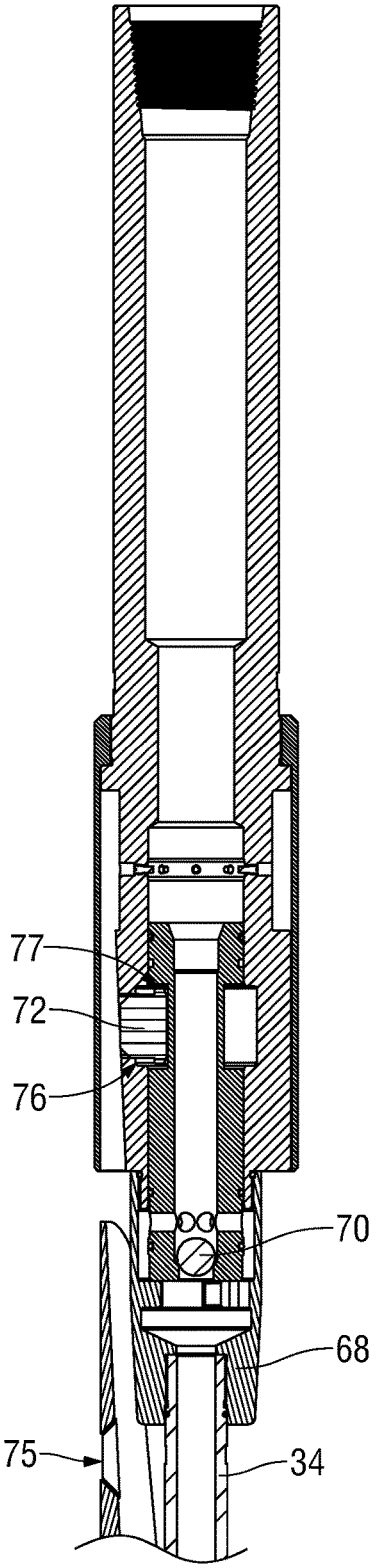

Referring to FIG. 4C, a large ball 70, which is of larger diameter than anchor setting ball 50, is configured to sealably land in a seat 59 formed inside locking sleeve 66 which is housed in the center of running tool 60. Upon the ball's landing in seat 59 inside the distal, downhole end of locking sleeve 66, large ball 70 seals a central, axial bore in this locking sleeve 66, causing locking sleeve 66 to now function as a sliding hydraulic piston. After large ball 70 seats, flow through the central bore of locking sleeve 66 stops, which also stops fluid flow from proceeding further downhole through cement tube 34 and connected anchor 20 and anchor setting sub 40. With the addition of sufficient pressure pumped from the surface, locking sleeve 66 shears a plurality of shears screws 67 that hold it in place. The locking sleeve 66 slides downward, downhole, until it passes into a locking sleeve catcher 68 that contains a locking sleeve cavity 69, clearly visible in FIG. 4B, with locking sleeve cavity 69 being of larger inside diameter than the outside diameter of locking sleeve 66, and locking sleeve 66 ends its travel on the flat faces of catching tabs 61, at the bottom of locking sleeve cavity 69. At this point, fluid ports 65 formed radially in the lower portion of locking sleeve 66 enter into fluid communication with the larger diameter area of locking sleeve cavity 69 and a flow passageway is ensured by catching tabs 61 formed in the lower end of locking sleeve catcher 68. Below catching tabs 61 another cavity, lower locking sleeve cavity 63, formed in locking sleeve catcher 68, is located proximal to and downhole from locking sleeve cavity 69. The locking sleeve 66 abuts the upper end of cement tube 34, with locking sleeve cavity's 69 inside diameter threadably and sealably connecting with the threaded outside diameter of the upper end of cement tube 34. Fluid communication is thereby re-established from the surface through locking sleeve 66, cement tube 34, anchor 20, and anchor setting sub 40 such that a cementing operation may be executed. However, best practices require that a pull test, as described herein, should be performed prior to cementing. The components that enable the pull test are detailed in FIGS. 4B and 4C, as well as 9A, 9B, 9C and 9D below.

In sum, following actuation of the locking sleeve via ball drop, fluid pumped from the surface regains fluid communication with the cement tube and the downhole portion of the wellbore beyond the anchor setting sub. A pressure-activated withdrawal mechanism partially releases the running tool from the whipstock after the anchor is set and indicates thereby the position of the cement tube, in its unrestrained state, within the whipstock's central bore.

Referring again to FIGS. 4B and 4C, following actuation of locking sleeve 66, this unlatching operation occurs as described herein. The latch dog 72, located initially in two orifices, or pockets, whipstock pocket 75, and running tool pocket 76, actuates in a radially inward direction such that it lands in a third pocket, latch dog pocket 77, as seen in FIG. 4C. FIG. 4B illustrates how these two pockets initially house latch dog 72 and how the 45-degree symmetrically angled orifice of whipstock pocket 75 matches the congruent angle of the radially distal (from axial center of the assembly) portion of latch dog 72. In its initial position, as shown in FIG. 4B, latch dog 72 abuts body sleeve 64 and insertably retains whipstock 12 and running tool body 62 together, preventing any sliding motion that could separate running tool 60 and whipstock 12. The radially inward movement of latch dog 72 is enabled by locking sleeve 66 shifting downward after the ball drop. Latch dog pocket 77 moves into alignment with whipstock pocket 75 and running tool pocket 76, such that latch dog pocket 77 may accept into it a portion of latch dog 72. Pulling force applied from the surface rig causes sliding of the reflex-angled portion of latch dog 72 against the matching obtuse angle of whipstock pocket 75 such that latch dog 72 is forced inward until it is positioned only within running tool pocket 76 and latch dog pocket 77. At this stage, latch dog 72 is only retained by running tool pocket 76 and latch dog pocket 77, and not whipstock pocket 75, as seen in FIG. 4C. The running tool body 62, along with threadably connected locking sleeve catcher 68 and cement tube 34, are permitted to slidably travel independently of whipstock 12 over a defined distance. At this stage, the unlatching operation has concluded and vertical travel of running tool 60 and attached cement tube 34 is enabled.

Figure 5:
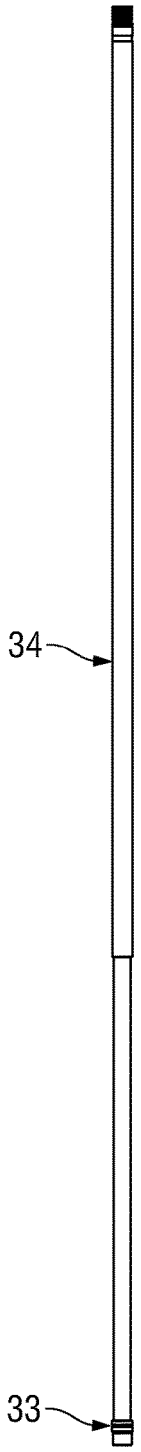
FIG. 5 illustrates cement tube and its larger diameter portion, at the lower, downhole end of the cement tube formed according the teachings of the present disclosure.

FIG. 5 illustrates cement tube 34 and its larger diameter portion 33, at the lower, downhole end of cement tube 34. The larger diameter portion 33 serves to limit upward travel when said larger diameter portion encounters shear screws as described herein.

Figure 6:
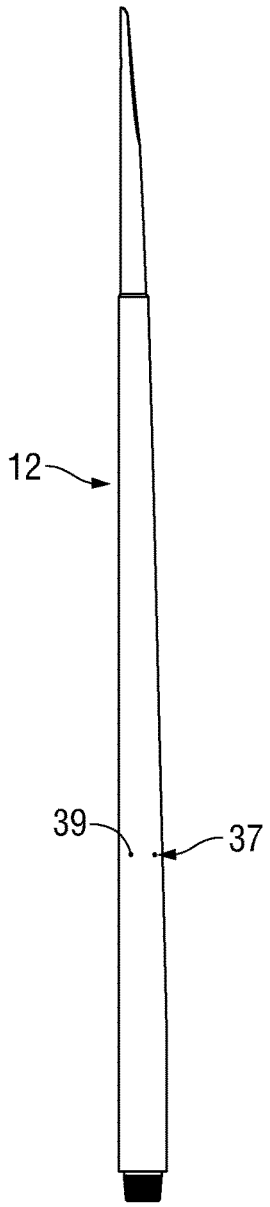
FIG. 6 illustrates the whipstock, into which cement tube is inserted according to the teachings of the present disclosure.

FIG. 6 illustrates whipstock 12, into which cement tube 34 is inserted. Visible in the lower, downhole half of whipstock 12 are a plurality of radial, threaded holes 39 through the wall of whipstock 12, through which shear screws 37 are inserted.

Figure 7:
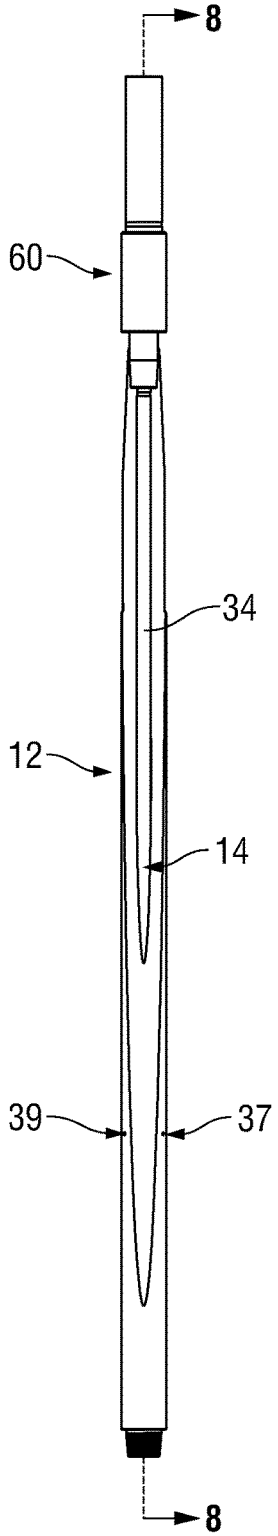
FIG. 7 depicts the whipstock with running tool attached and cement tube inserted into the whipstock's central bore according the teachings of the present disclosure.

FIG. 7 illustrates whipstock 12 with running tool 60 attached and cement tube 34 inserted into whipstock's central bore 14. FIG. 7 depicts running tool 60 in its initial position when inserted into the wellbore, before the unlatching operation and pull test have been executed.

Figure 8:
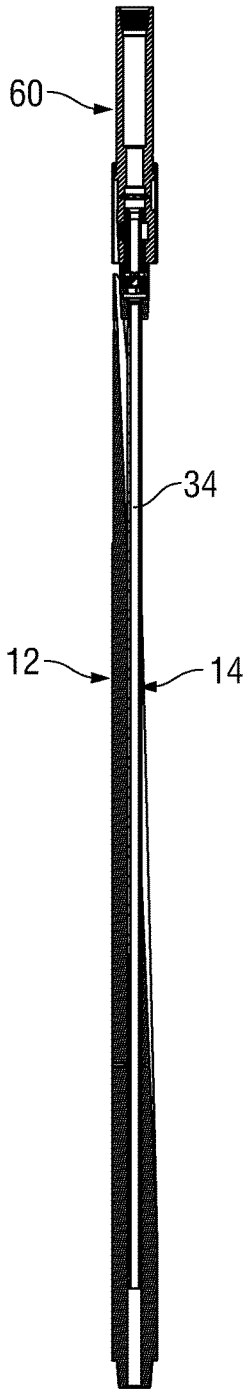
FIG. 8 depicts a half section view of the whipstock, attached running tool and inserted cement tube rotated 90 degrees from the view in FIG. 7.

FIG. 8 depicts a half section view of whipstock 12, attached running tool 60 and inserted cement tube 34 rotated 90 degrees from the view in FIG. 7.

FIGS. 9A to 9E depict the stages of vertical travel of running tool 60 and attached cement tube 34 during a pull test and subsequent withdrawal toward the surface. Shear screws 37 are depicted providing a stop against overtravel of cement tube 34.

Figure 9A:
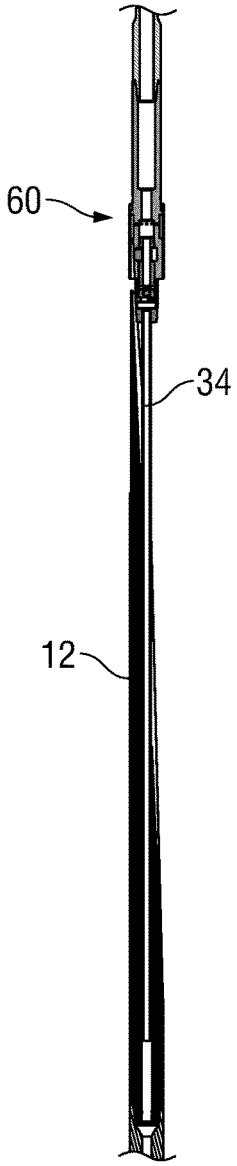
FIGS. 9A through 9E depict the stages of vertical travel of the running tool and attached cement tube during a pull test and subsequent withdrawal toward the surface.

FIG. 9A illustrates whipstock 12 in half section view, with attached running tool 60 and cement tube 34 in their initial position, with running tool 60 and whipstock 12 engaged, before the unlatching operation and pull test have been executed.

Figure 9B:
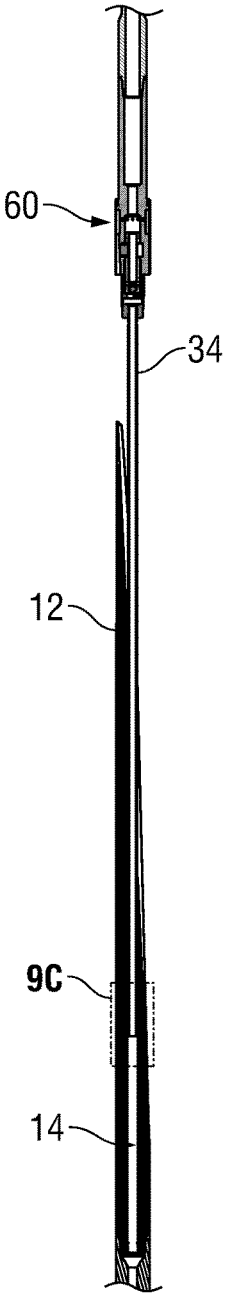

FIG. 9B illustrates whipstock 12 in half section view, with attached running tool 60 and cement tube 34 after the unlatching operation has been executed and running tool 60 and attached cement tube 34 have been pulled upward two feet, for example, indicating a successful pull test. The cement tube 34 remains sealably and slidably engaged within the whipstock's central bore 14.

Figure 9C:
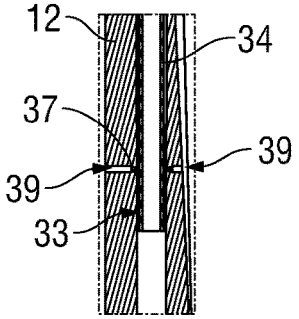

FIG. 9C depicts an enlarged section view of a lower part of whipstock 12 that contains shear screws 37 inserted into threaded holes 39. The shear screws 37 limit the upper travel of larger diameter portion 33 of cement tube 34. The shear screws 37 stop the upward, uphole vertical travel of cement tube 34 until the pulling force sufficient to shear the screws for withdrawal from the wellbore is applied. Additionally, shear screws 37 are positioned such that upward, uphole vertical travel is limited to a distance of four feet, for example, following the unlatching operation.

Figure 9D:
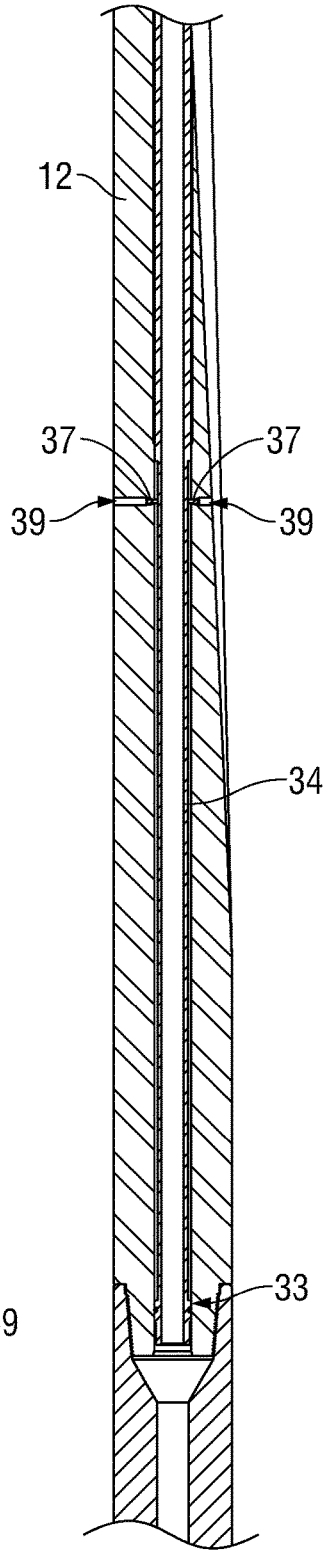

FIG. 9D depicts an enlarged section view of a lower part of whipstock 12 with cement tube 34 in its initial position, prior to unlatching, in the same state as shown in FIG. 9A. Shear screws 37 are inserted into threaded holes 39 in whipstock 12. After unlatching and pull for a pull test are initiated, shear screws 37 will limit the upper travel of larger diameter portion 33 of cement tube 34. The shear screws 37 stop the upward, uphole vertical travel of cement tube 34 until the pulling force sufficient to shear the screws for withdrawal from the wellbore is applied. Additionally, shear screws 37 are positioned such that upward, uphole vertical travel is limited to a distance of four feet, for example, during the pull test that follows the unlatching operation.

Figure 9E:
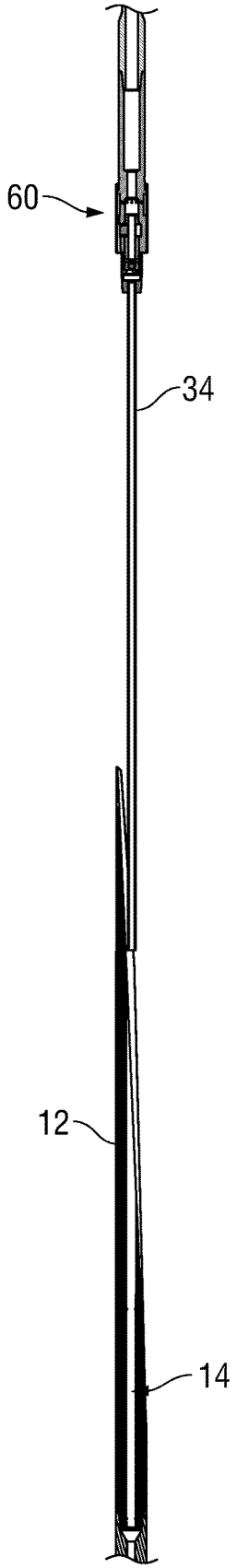

FIG. 9E illustrates whipstock 12 in half section view, with attached running tool 60 and cement tube 34 being pulled upward toward the surface after the cementing operation has been completed. In this view, the unlatching operation, pull test, and cementing operation have been completed, and sufficient pulling force to shear shear screws 37 has been applied from the surface. The cement tube 34 has been pulled upward, uphole, and has exited the whipstock's central bore 14, beginning its withdrawal to the surface.

FIGS. 10A to 10E illustrate running tool 60 with radial section views perpendicular to the central axis of running tool 60.

Figure 10A:
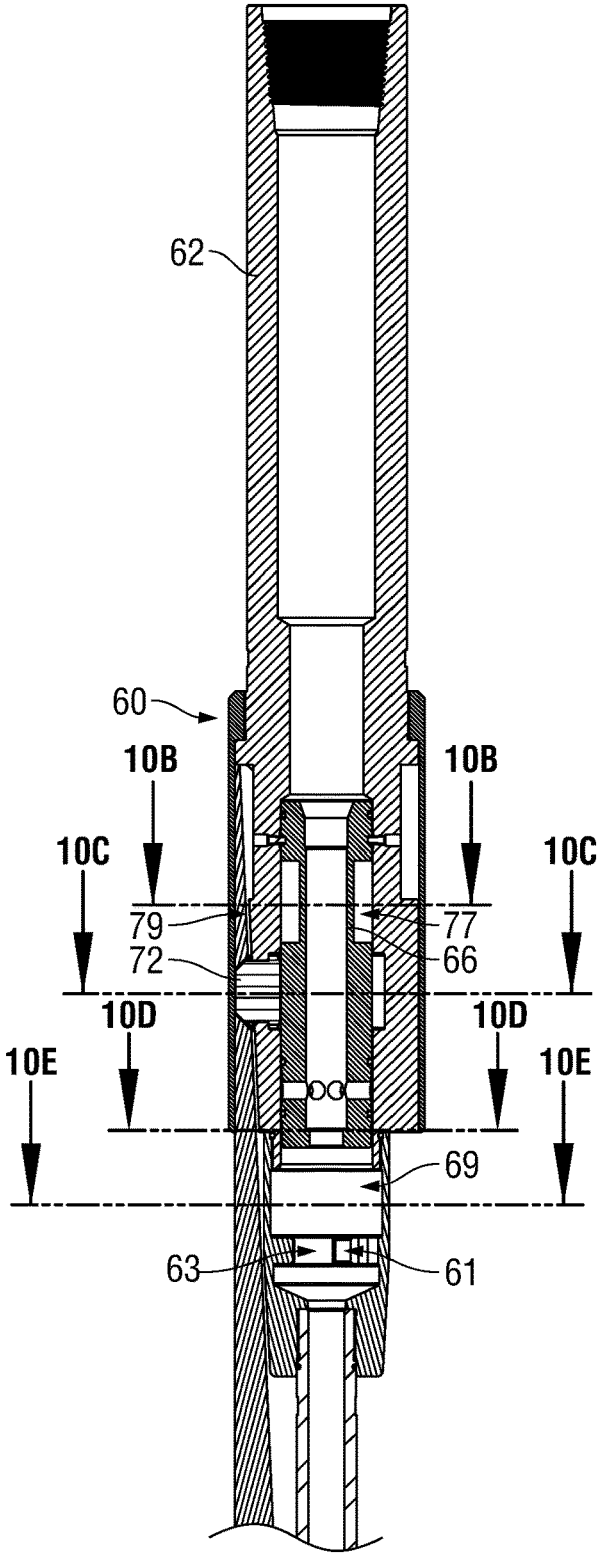
FIG. 10A depicts a side section view of running tool in a state of being latchably engaged to the whipstock, with various radial cross-sections marked.

FIG. 10A depicts running tool 60 in side section view, similar to FIG. 4B, but without a ball having been dropped. Locking sleeve 66 is shown in its narrow diameter portion that creates a space comprising latch dog pocket 77, the pocket into which latch dog 72 retreats. Also depicted here are catching tabs 61 located in lower locking sleeve cavity 63, below and adjacent to locking sleeve cavity 69. Four section views are marked for radial views looking from an uphole to downhole perspective along the central axis of running tool 60.

Figure 10B:
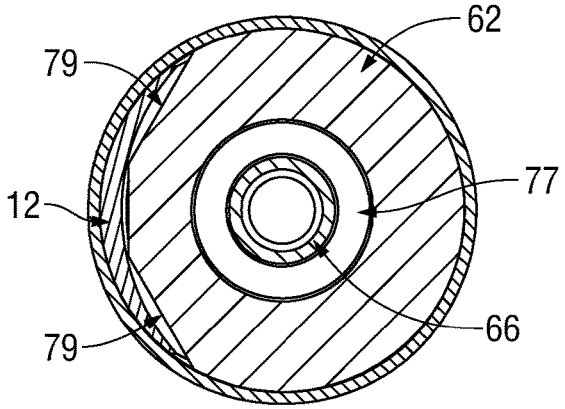
FIGS. 10B through 10E illustrate radial section views of the running tool with these views taken perpendicular to the central axis of running tool.

FIG. 10B illustrates a cross section of running tool 60 from an uphole to downhole perspective along the central axis of running tool 60. Of particular importance are two flat faces 79 milled along a longitudinally sloping portion of running tool body 62, which, when abutting whipstock 12 as depicted, prevent rotation in relation to whipstock 12. Locking sleeve 66 is shown in its reduced, narrower diameter portion that creates a space comprising latch dog pocket 77, the pocket into which latch dog 72 retreats.

Figure 10C:
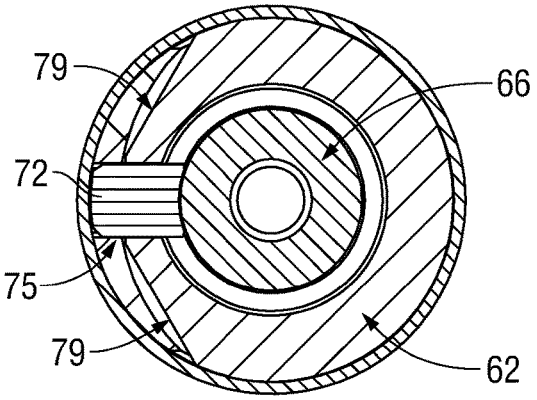

FIG. 10C depicts a cross section of running tool 60 from an uphole to downhole perspective along the central axis of running tool 60, slightly farther downhole than FIG. 10B. The two flat faces 79 milled along a longitudinally sloping portion of running tool body 62, utilized for preventing rotation in relation to whipstock 12, are again visible. Also shown is latch dog 72 in its initial, unlatched position, with latch dog 72 housed in whipstock pocket 75. A full diameter portion of locking sleeve 66 is shown.

Figure 10D:
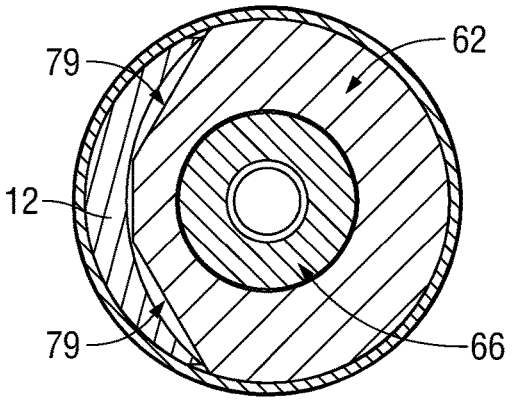

FIG. 10D depicts a cross section of running tool 60 from an uphole to downhole perspective along the central axis of running tool 60, slightly farther downhole than FIG. 10C. Two flat faces 79 milled along a longitudinally sloping portion of running tool body 62, utilized for preventing rotation in relation to whipstock 12, are visible here as well. Locking sleeve 66 is shown at full diameter, slidably engaging the inside diameter of running tool body 62.

Figure 10E:
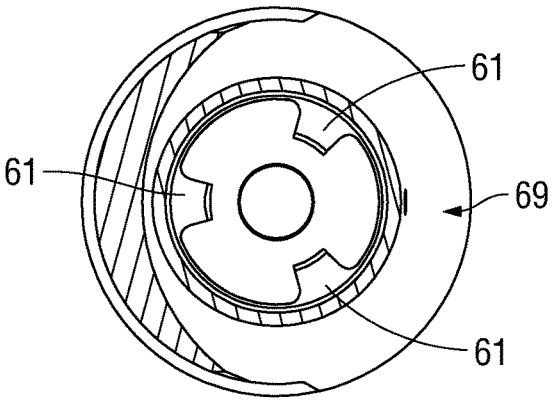

FIG. 10E depicts a cross section of running tool 60 from an uphole to downhole perspective along the central axis of running tool 60, slightly farther downhole than FIG. 10D. Depicted here are catching tabs 61 located in lower locking sleeve cavity 63, below and adjacent to locking sleeve cavity 69.

Figure 11A:
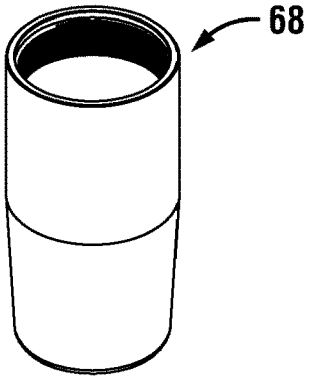
FIG. 11A illustrates an external perspective view of the locking sleeve catcher.

FIG. 11A illustrates an external perspective view of locking sleeve catcher 68.

Figure 11B:
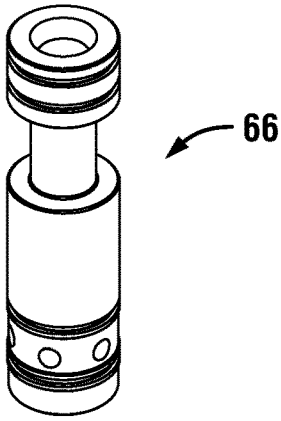
FIG. 11B illustrates an external perspective view of the locking sleeve and its smaller diameter portion for receiving the latch dog.

FIG. 11B illustrates an external perspective view of locking sleeve 66.

Figure 11C:
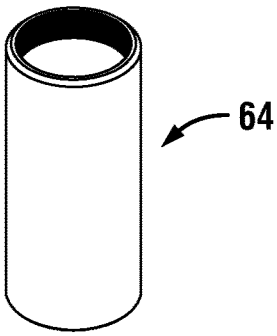
FIG. 11C illustrates an external perspective view of the body sleeve of the present disclosure.

FIG. 11C illustrates an external perspective view of body sleeve 64.

Figure 11D:
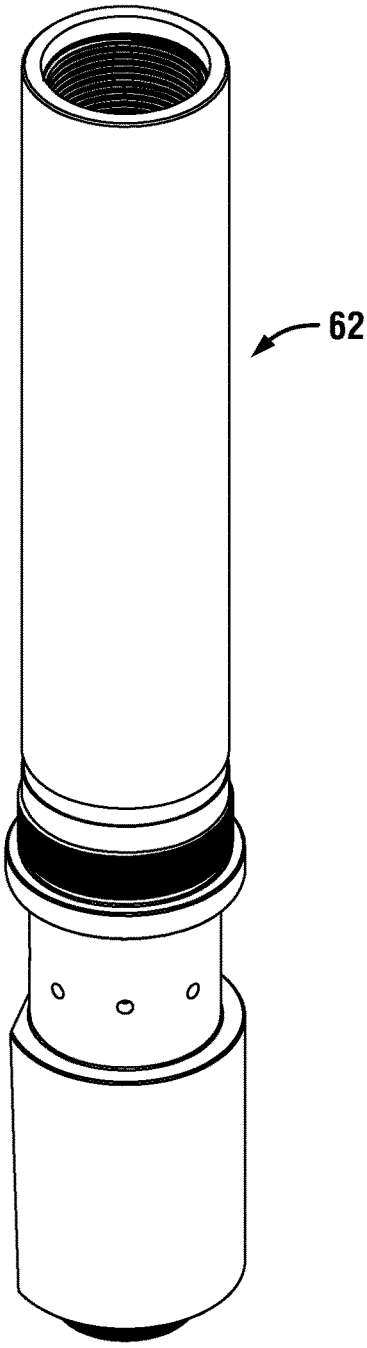
FIG. 11D illustrates an external perspective view of the running tool body.

FIG. 11D illustrates an external perspective view of running tool body 62.

Figure 12A:
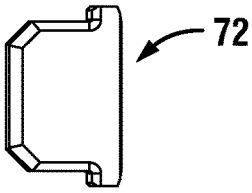
FIGS. 12A through 12C are perspective views of the latch dog mechanism of the present disclosure.

FIG. 12A illustrates a side perspective view of latch dog 72.

Figure 12B:
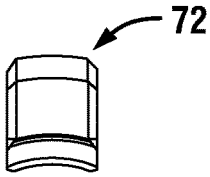

FIG. 12B illustrates an overhead perspective view of latch dog 72.

Figure 12C:
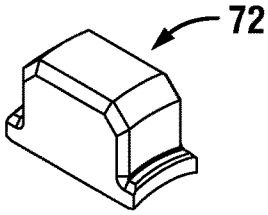

FIG. 12C illustrates a perspective view of latch dog 72.

The running tool is made from alloy steel with enough strength and durability to run in and out of the wellbore during running tool cementing operations. In addition, the running tool has sufficient strength to permit pushing and pulling the running tool up and down the wellbore hole in the event of an obstruction or snag that would prevent its movement to desired positions.

Although only a few embodiments have been described in detail above, those of ordinary skill in the art will readily appreciate that many modifications are possible without materially departing from the teachings of this disclosure. Accordingly, such modifications are intended to be included within the scope of this disclosure.

Although the whipstock assembly and methods of operation for minimizing downhole trips during lateral drill sidetracking operations here disclosed have been described in detail herein with reference to the illustrative embodiments, it should be understood that the description is by way of example only and is not to be construed in a limiting sense. It is to be further understood, therefore, that numerous changes in the details of the embodiments of this disclosed process and additional embodiments of this method and system will be apparent to, and may be made by, persons of ordinary skill in the art having reference to this description. It is contemplated that all such changes and additional embodiments are within the spirit and true scope of this disclosed method and system as claimed below.

In summary, the present disclosure provides an assembly for subterranean use and employing a reusable running tool in association with a whipstock and anchor combination. The assembly includes a whipstock positioned within a wellbore, and an anchor positioned within the wellbore. A reusable running tool releasably supports the whipstock and anchor within wellbore. The running tool includes a running tool body for engaging the whipstock and providing structural support and fluid communication through the running tool while the running tool engages the whipstock and anchor. A cement tube operates in selective fluid communication with the running tool for receiving fluid cement from the running tool and flowing the fluid cement through the whipstock, through the anchor, and through the anchor setting sub in order to form a cement plug. A latch dog controllably and releasably associates the running tool with the whipstock. A pressure-activated withdrawal mechanism partially releases the running tool from the whipstock after the anchor is set. A ball is configured for providing a controllable flow obstruction to initiate the unlatching of the running tool. A latch dog, a plurality of shear screws, and a locking sleeve are all configured for providing a pressure-activated release following dropping of said ball. The release of the latch dog from the whipstock enables limited upward, uphole travel of the running tool, indicating thereby the position of the attached cement tube within the whipstock. Said running tool and cement tube can be raised a designed distance during a pull test using a first pull tension, and a greater second pull tension can be taken to verify that said cement tube still engages said whipstock. With verification of said cement tube being in a slidably movable state but still engaged with said whipstock, fluid cement can be pumped downhole to set the cement plug. Following cementing, a still greater third pull tension shears shear screws retaining the cement tube within the whipstock, enabling full withdrawal of the running tool and cement tube from the wellbore. The full withdrawal of the reusable running tool permits the running tool to be redressed and used in subsequent cement plug setting operations.

In a further aspect of the present disclosure, here is provided a sidetracking assembly for subterranean use in a wellbore. The sidetracking assembly encompasses novel features and methods, as well as methods of manufacturing the assembly. These result in a whipstock and a hydraulically actuable anchor. The whipstock and hydraulically actuable anchor may be positioned within a wellbore. A reusable running tool releasably supports the whipstock and anchor within the wellbore, and further includes a running tool for engaging the whipstock and providing structural support and fluid communication through the running tool while the running tool engages the whipstock and hydraulically actuable anchor. A cement tube housed in said whipstock is in selective fluid communication with the running tool and hydraulically actuable anchor for providing a flowpath through sidetracking assembly and downhole into the wellbore for transmission of fluids. The fluids include a low viscosity fluid for fluidly carrying a ball to a ball seat carrier. The ball seat carrier includes a ball seat and is positioned below the hydraulically actuable anchor. The ball serves to obstruct the flowpath and cause a first pressure increase upon seating on ball seat in the ball seat carrier. The first pressure increase sets the hydraulically actuable anchor in place in the wellbore. A second, greater pressure increase releases the ball seat carrier and reestablishes flowpath for downhole transmission of fluids.

The fluids further include a fluid cement for flowing through the sidetracking assembly and downhole so as to form a cement plug in the wellbore. A locking sleeve includes a ball seat and associated latch dog, The latch dog is disposed within the running tool body and releasably engages with the whipstock.

The latch dog may be released from the whipstock by ball-seat pressure-activated withdrawal from said whipstock and into the locking sleeve after the anchor is set. Here, the latch dog release enables limited vertical travel of the cement tube to provide relative movement and indicate position of the cement tube within the whipstock. The locking sleeve catcher threadably attaches to the running tool and threadably attaches to the cement tube for controllably and releasably associating the cement tube with said whipstock.

A plurality of shear screws threadably engage with the whipstock and extending into a central bore in said whipstock for engaging the cement tube. The shear screws retain a larger diameter portion of the cement tube for stopping upward slidable travel upon contacting the shear screws with the larger diameter portion when applying a pulling force.

In a plurality of various embodiments, the running tool and cement tube may be raised a predetermined distance using a first pulling force at any time after setting the hydraulically actuable anchor and after releasing the latch dog from engagement with the whipstock. Here, too, a second greater pulling force may be applied to brings the larger diameter portion of the cement tube into contact with said shear screws. This position may be taken to verify that the cement tube still engages the whipstock. Yet further, a third greater pulling force may be applied to shear the shear screws and release the cement tube from engagement with the whipstock.

The foregoing description of embodiments is provided to enable any person skilled in the art to make and use the subject matter. Various modifications to these embodiments will be readily apparent to those skilled in the art, and the novel principles and subject matter disclosed herein may be applied to other embodiments without the use of the innovative faculty. The claimed subject matter set forth in the claims is not intended to be limited to the embodiments shown herein but is to be accorded the widest scope consistent with the principles and novel features disclosed herein. It is contemplated that additional embodiments are within the spirit and true scope of the disclosed subject matter.

What is claimed is:

1. A sidetracking assembly for subterranean use in a wellbore, comprising:

a whipstock and an anchor;

said whipstock positioned within a wellbore and comprising a plurality of shear screws, said shear screws inserted through said whipstock and extending radially inward into a central bore of said whipstock;

said anchor positioned within a wellbore for securing aid whipstock securely within said wellbore;

a running tool releasably supporting said whipstock and said anchor within said wellbore, and further comprising said running tool for engaging said whipstock and providing structural support for said whipstock and said anchor, said running tool housing a latch dog, said latch dog for securely engaging said whipstock and said running tool in a first position, said running tool housing a shearably releasable locking sleeve, said locking sleeve containing a cavity for receiving and retaining said latch dog after said locking sleeve shearably releases from said running tool, said latch dog configured for disengaging from said whipstock upon shear release of said locking sleeve and moving to a second position of being partially received into said locking sleeve while retaining engagement with said running tool;

a cement tube housed in said whipstock, said cement tube, comprising a concentric form of a first outside diameter and with a second outside diameter portion at a downhole end of said cement tube, said second outside diameter configured to be greater than said first outside diameter, in communication with and releasably attaching to said running tool and said anchor, wherein said first outside diameter is within an axial diameter defined by said plurality of shear screws, but said second outside diameter is larger than said axial diameter;

said running tool configured for releasing said running tool from said whipstock and thereby enabling limited axially uphole travel of said cement tube providing relative movement and indicating position of said cement tube within said whipstock, and wherein said running tool and said cement tube are configured to be raised through a sequence of predetermined distances along the central bore of said whipstock using three pulling forces, said three pulling forces comprising a cement tube raising force for applying at any time after setting said anchor and after releasing said running tool from engagement with said whipstock and upward within said central bore, and a shear screw contacting force, said shear screw contacting force greater than said cement tube raising force, for raising said cement tube to contact said plurality of shear screws while said cement tube still engages said whipstock, without shearing said plurality of shear screws; and a shear screw shearing force, said shear screw shearing force greater than said shear screw contacting force for applying to shear at least a subset of said plurality of shear screws and thereby removing the obstruction of said plurality of shear screws against said cement tube at said second outside diameters and thereby permitting withdrawal of said cement tube from said running tool and the wellbore.

2. The sidetracking assembly of claim 1, and further wherein a fluid cement can be pumped downhole to set a cement plug and said running tool can be pulled with sufficient force to shear said shear screws so as to release said running tool from said whipstock using said third pulling force, thereby enabling withdrawal of said running tool from the wellbore.

3. The sidetracking assembly of claim 1, wherein said locking sleeve is configured to be shearably releasable from said running tool and to receive and retain said latch dog in a cavity of said locking sleeve.

4. The sidetracking assembly of claim 1, wherein the anchor further comprises a hydraulically actuable anchor assembly coupled to said whipstock assembly.

5. The sidetracking assembly of claim 4, wherein said anchor assembly is arranged and designed to anchor said whipstock assembly in an open hole.

6. The sidetracking assembly of claim 4, said anchor assembly including multiple slips configured to expand and engage a wall of the wellbore.

7. The sidetracking assembly of claim 4, said anchor assembly being configured to be set at a predetermined wellbore depth.

8. The sidetracking assembly of claim 4, further comprising a ball seat and ball seat carrier for blocking flow through a flowpath to enable setting of said anchor assembly.

9. A lateral drilling method using a sidetracking assembly for subterranean use in a wellbore, comprising the steps of:

providing a whipstock and an anchor;

positioning said whipstock positioned within a wellbore and comprising a plurality of shear screws, said shear screws inserted through said whipstock and extending radially inward into a central bore of said whipstock;

said anchor positioned within a wellbore for securing aid whipstock securely within said wellbore;

providing a running tool releasably supporting said whipstock and said anchor within said wellbore, and further comprising said running tool for engaging said whipstock and providing structural support for said whipstock and said anchor, said running tool housing a latch dog, said latch dog for securely engaging said whipstock and said running tool in a first position, providing in said running tool housing a shearably releasable locking sleeve, said locking sleeve containing a cavity for receiving and retaining said latch dog after said locking sleeve shearably releases from said running tool, providing said latch dog configured for disengaging from said whipstock upon shear release of said locking sleeve and moving to a second position of being partially received into said locking sleeve while retaining engagement with said running tool;

providing a cement tube housed in said whipstock, said cement tube, comprising a concentric form of a first outside diameter and with a second outside diameter portion at a downhole end of said cement tube, said second outside diameter configured to be greater than said first outside diameter, in communication with and releasably attaching to said running tool and said anchor, wherein said first outside diameter is within an axial diameter defined by said plurality of shear screws, but said second outside diameter is larger than said axial diameter;

releasing said running tool from said whipstock and thereby enabling limited axially uphole travel of said cement tube providing relative movement and indicating position of said cement tube within said whipstock, and raising said running tool and said cement tube through a sequence of predetermined distances along the central bore of said whipstock using three pulling forces, said three pulling forces comprising a cement tube raising force for applying at any time after setting said anchor and after releasing said running tool from engagement with said whipstock and upward within said central bore, and a shear screw contacting force, said shear screw contacting force greater than said cement tube raising force, for raising said cement tube to contact said plurality of shear screws while said cement tube still engages said whipstock, without shearing said plurality of shear screws; and a shear screw shearing force, said shear screw shearing force greater than said shear screw contacting force for applying to shear at least a subset of said plurality of shear screws and thereby removing the obstruction of said plurality of shear screws against said cement tube at said second outside diameters and thereby permitting withdrawal of said cement tube from engagement with said running tool and the wellbore.

10. The lateral drilling method using a sidetracking assembly of claim 9 and further comprising the step of pumping a fluid cement downhole to set a cement plug and said running tool can be pulled with sufficient force to shear said shear screws so as to release said running tool from said whipstock using said third pulling force, thereby enabling withdrawal of said running tool from the wellbore.

11. The lateral drilling method using a sidetracking assembly of claim 9 and further comprising the step of configuring said locking sleeve to be shearably releasable from said running tool and to receive and retain said latch dog in a cavity of said locking sleeve.

12. The lateral drilling method using a sidetracking assembly of claim 9, wherein the anchor further comprises a hydraulically actuable anchor assembly, the method further comprising the step of coupling the hydraulically actuable anchor assembly to said whipstock assembly.

13. The lateral drilling method using a sidetracking assembly of claim 12, and further comprising the step of arranging said anchor assembly to anchor said whipstock assembly in an open hole.

14. The lateral drilling method using a sidetracking assembly of claim 12, and further comprising the step of configuring said anchor assembly to include multiple slips configured to expand and engage a wall of the wellbore.

15. The lateral drilling method using a sidetracking assembly of claim 12, and further comprising the step of configuring said anchor assembly set at a predetermined wellbore depth.

16. The lateral drilling method using a sidetracking assembly of claim 12, further comprising the step of blocking flow through a flowpath to enable setting of said anchor assembly using a ball seat and ball seat carrier.

17. A method of manufacturing a sidetracking assembly for subterranean use in a wellbore, comprising:

forming a whipstock and an anchor;

said whipstock positioned within a wellbore and comprising a plurality of shear screws, said shear screws inserted through said whipstock and extending radially inward into a central bore of said whipstock;

said anchor positioned within a wellbore for securing aid whipstock securely within said wellbore;

forming a running tool releasably supporting said whipstock and said anchor within said wellbore, and further comprising said running tool for engaging said whipstock and providing structural support for said whipstock and said anchor, said running tool housing a latch dog, said latch dog for securely engaging said whipstock and said running tool in a first position, said running tool housing a shearably releasable locking sleeve, said locking sleeve containing a cavity for receiving and retaining said latch dog after said locking sleeve shearably releases from said running tool, said latch dog configured for disengaging from said whipstock upon shear release of said locking sleeve and moving to a second position of being partially received into said locking sleeve while retaining engagement with said running tool;

forming a cement tube housed in said whipstock, said cement tube, comprising a concentric form of a first outside diameter and with a second outside diameter portion at a downhole end of said cement tube, said second outside diameter configured to be greater than said first outside diameter, in communication with and releasably attaching to said running tool and said anchor, wherein said first outside diameter is within an axial diameter defined by said plurality of shear screws, but said second outside diameter is larger than said axial diameter;

said running tool configured for releasing said running tool from said whipstock and thereby enabling limited axially uphole travel of said cement tube providing relative movement and indicating position of said cement tube within said whipstock, and wherein said running tool and said cement tube are configured to be raised through a sequence of predetermined distances along the central bore of said whipstock using three pulling forces, said three pulling forces comprising a cement tube raising force for applying at any time after setting said anchor and after releasing said running tool from engagement with said whipstock and upward within said central bore, and a shear screw contacting force, said shear screw contacting force greater than said cement tube raising force, for raising said cement tube to contact said plurality of shear screws while said cement tube still engages said whipstock, without shearing said plurality of shear screws; and a shear screw shearing force, said shear screw shearing force greater than said shear screw contacting force for applying to shear at least a subset of said plurality of shear screws and thereby removing the obstruction of said plurality of shear screws against said cement tube at said second outside diameters and thereby permitting withdrawal of said cement tube from said running tool and the wellbore.

18. The method of manufacturing a sidetracking assembly of claim 17, and further comprising the step of forming said a fluid cement can be pumped downhole to set a cement plug and said running tool can be pulled with sufficient force to shear said shear screws so as to release said running tool from said whipstock using said third pulling force, thereby enabling withdrawal of said running tool from the wellbore.

19. The method of manufacturing a sidetracking assembly of claim 18, further comprising the step of forming said locking sleeve to be shearably releasable from said running tool and to receive and retain said latch dog in a cavity of said locking sleeve.

20. The method of manufacturing a sidetracking assembly of claim 18, wherein the anchor further comprises a hydraulically actuable anchor assembly, the method further comprising the step of forming the hydraulically actuable anchor assembly coupled to said whipstock assembly.

* * * * *